United States Patent [19]

Duncan

[11] 4,157,138

[45] Jun. 5, 1979

[54] WRAPPER FOR AN ARTICLE OF MERCHANDISE

[75] Inventor: Ronnie D. Duncan, Muskogee, Okla.

[73] Assignee: Container Corporation of America, Chicago, Ill.

[21] Appl. No.: 885,481

[22] Filed: Mar. 13, 1978

[51] Int. Cl.[2] ..... B65D 5/35

[52] U.S. Cl. ..... 206/315 R; 206/443; 206/822; 229/23 BT

[58] Field of Search ..... 229/40, 23 BT, 87 R; 206/277, 315 R, 822, 443

[56] References Cited

U.S. PATENT DOCUMENTS

| | | | |
|---|---|---|---|
| 2,759,651 | 8/1956 | Dowd | 229/23 BT |
| 3,356,282 | 12/1967 | Layne, Sr. | 229/40 |
| 3,841,548 | 10/1974 | Curley | 229/40 |
| 3,913,824 | 10/1975 | Paige | 229/23 BT X |
| 3,949,932 | 4/1976 | Shore | 229/40 |

FOREIGN PATENT DOCUMENTS

| | | | |
|---|---|---|---|
| 67540 | 2/1951 | Netherlands | 206/277 |

*Primary Examiner*—Joseph Man-Fu Moy
*Attorney, Agent, or Firm*—Carpenter & Ostis

[57] ABSTRACT

A wrapper for a long article of merchandise, such as a hull of a double ended canoe or similar water craft, or the like is disclosed. The wrapper is formed from a plurality of cut and scored blanks of paperboard or the like, each of which when folded to position, defines a tube enveloping a portion of the article.

4 Claims, 5 Drawing Figures

WRAPPER FOR AN ARTICLE OF MERCHANDISE

FIELD OF THE INVENTION

The wrapper according to the present invention finds particular application in enclosing an elongate article such as a canoe hull or the like formed from self curing fiberglass laden resins, such as polyesters or epoxies. Such hulls are made in varying lengths and may be nested for shipping. The ultimate fabricator then finishes the hulls with the customary thwarts and gunwale rails as is known in the art.

SUMMARY OF THE INVENTION

The structure according to the present invention enables one or more double ended canoes to be enclosed, the contour of the wrapper taught thereby closely approximating the contours of a canoe hull whether it be shipped singly or in nesting relationship.

THE DRAWINGS

Figure 5:
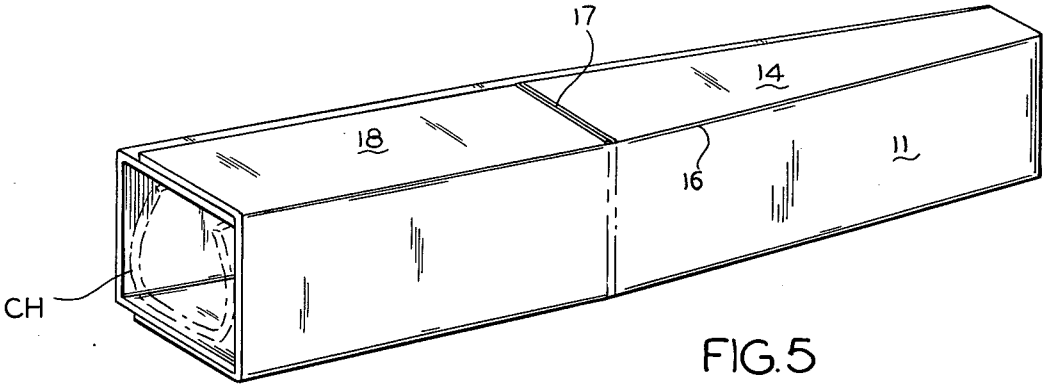
FIG. 5 is an isometric view showing the blank of FIG. 3 wrapped about an article enclosed therein.

A completed wrapper according to the present invention is denoted generally by the reference numeral 10 and is adapted to enclose an elongate article of commerce, such as a canoe hull CH. A plurality of such hulls may be arranged in nesting relationship if so desired.

Figure 4:
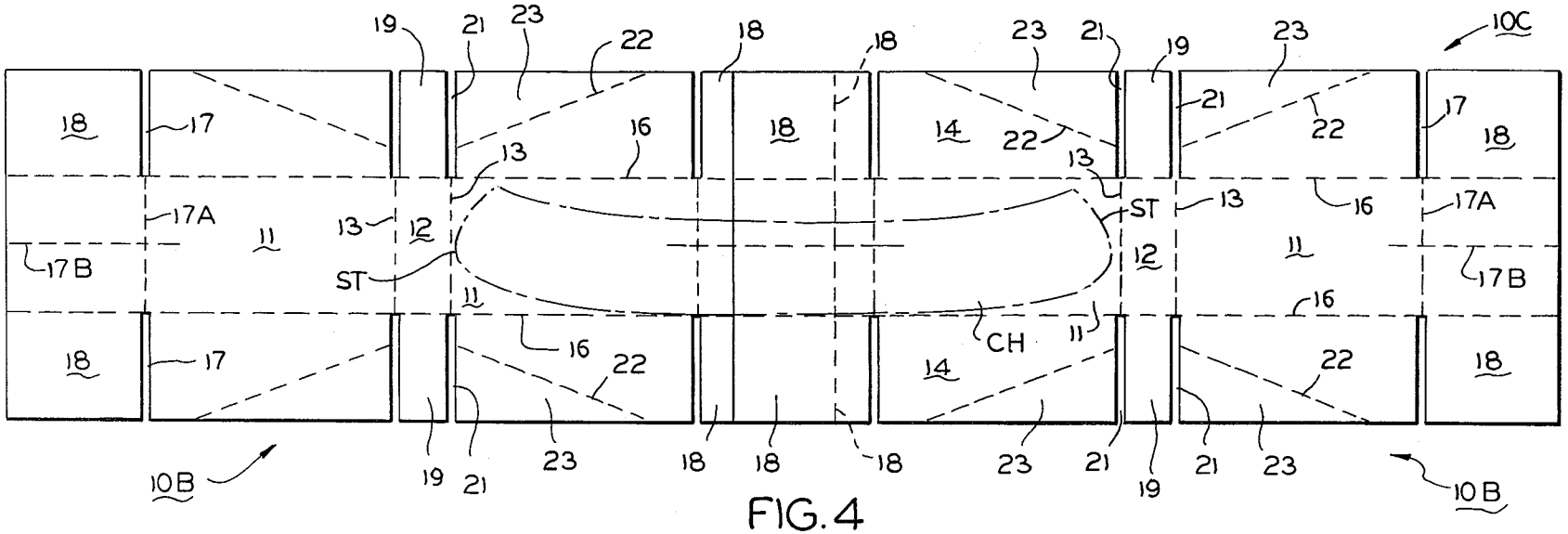
FIG. 4 is a plan view of a pair of the blanks seen in FIG. 3, having a number of articles placed thereon to have the blanks of FIG. 3 folded thereabout.

By reason of limitations in size of machines for forming cut and scored blanks of paperboard, the wrapper 10 may be formed from a number of blanks, these being indicated by the reference numerals 10A, 10B and 10C. Accordingly, a small blank 10A is glued to a like blank in an end-to-end relationship to provide a blank 10B. The blanks in the form of the blank 10B can be placed in reverse end-to-end relationship, as seen in FIG. 4, to place thereon a canoe hull CH which may have smaller hulls nested therein.

The blank 10B formed of blanks 10A which are glued together consists of pairs of first panels 11 foldably joined to a transverse end panel 12 along fold lines 13. The transverse end panel 12 is adapted to engage a stem portion ST of the hull CH when the panels 11 are folded into parallel relationship over and under the hull CH.

Opposed pairs of closure panels 14 are foldably joined to the first panels 11 along parallel fold lines 16 and are foldable into position to define a tube enclosing the hull CH. Each of the closure panels 14 includes a portion 18 defined by a slot 17 extending transversely to the panel 11. An extension 19 from the transverse end panel 12 is separated from panel 14 by a slot 21. The closure panel 14 has a diagonal score line 22 therein extending from the slot 21 to a distal edge of the panel 14 to define a triangularly shaped portion 23 therein.

As seen in several views, panels 11 are additionally provided with score lines 17A and 17B to assist in following the contours of the hull CH.

Figure 1:
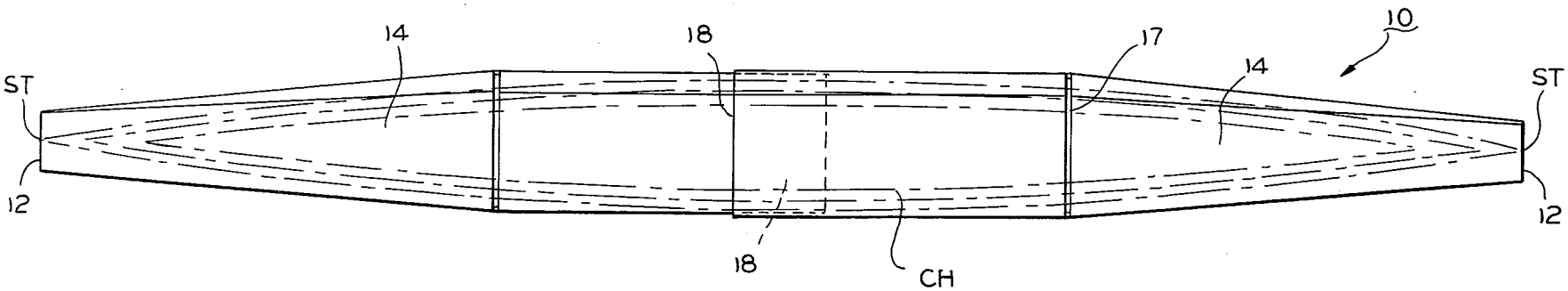
FIG. 1 is a plan view of a wrapper constructed in accordance with the teachings of the present invention.
Figure 3:
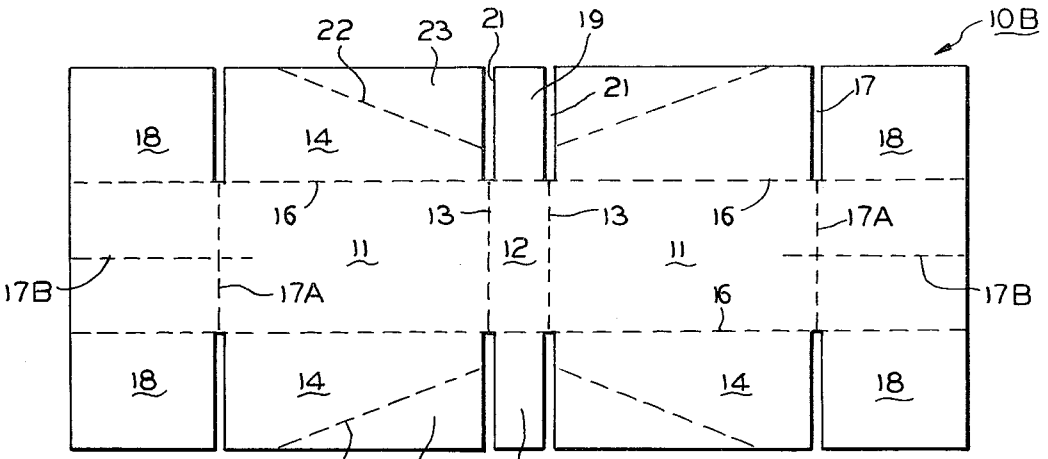
FIG. 3 is a plan view of a pair of blanks seen in FIG. 2, joined in end to end relationship.
Figure 2:
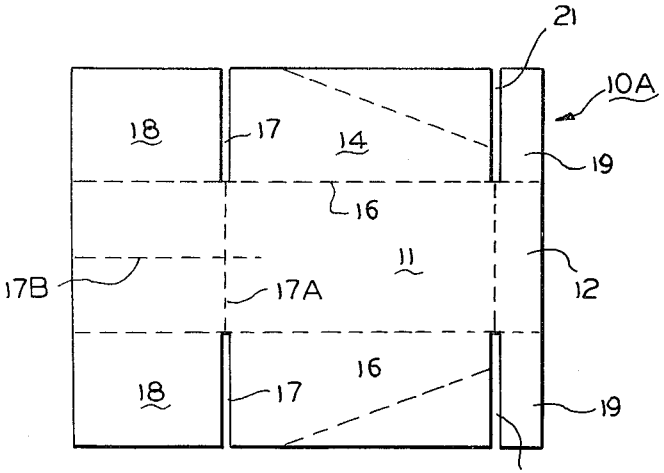
FIG. 2 is a plan view of a cut and scored blank for forming part of the wrapper seen in FIG. 1.

As best seen in FIGS. 1 and 4, blanks 10A forming the composite blank 10C are placed in reverse end-to-end relationship one atop the other. In enclosing the hulls CH they are placed upon their sides in nested relationship upon the first pair of panels 11, they being then folded over the hulls CH about the score lines 13, the transverse panel 12 being brought against the stems ST of the outer hull CH. The closure panels 14 have the flaps 23 thereof folded about the score lines 22, the extensions 19 from the transverse flaps 12 being brought inside the closure flaps 14 which are then folded to position about the score line 16.

The blanks 10B have the portions 18 of the closure flaps 14 in varying lapping relationship according to the length of the hull CH, and after the half tubes are formed about the hulls CH, the entire assembly is strapped together by conventional strapping, not shown.

I claim:

1. In a wrapper for a long article of merchandise such as the hull of a double ended watercraft such as a canoe or the like, said wrapper being formed from a plurality of cut and scored blanks of paperboard, or the like, each of which when folded to position defines a tube to envelop said article a distance greater than one-half the length thereof, each of said tubes comprising:

(a) a first pair of opposed panels foldably joined to a transverse end panel adapted to engage the ends of said article when said opposed panels are folded into parallel relationship;

(b) opposed pairs of closure panels foldably joined to said first pair of opposed panels along fold lines and foldable to position to define a tube enclosing said article;

(c) at least one panel of each pair of said closure panels having an edge oriented diagonally to and located remote from said fold lines connecting said closure panel to the respective one of said pair of opposed panels thereby forming a tube having a trapezoidal configuration and substantially conforming to the shape of said article;

(d) each of said tubes being placed in reverse end-to-end relationship with the aforesaid panels in telescoping relationship to enclose said articles.

2. The wrapper according to claim 1, wherein said closure panels are transversely slotted to provide additional panel portions foldable with respect to said first pair of opposed panels and having a capability of being folded into lapping relationship to enclose said article.

3. The wrapper according to claim 1, wherein said closure panels are defined by slots extending alongside extensions to said transverse end panel.

4. A wrapper according to claim 1, wherein said diagonal fold lines extend from the inner ends of said slots to the distal edges of said closure flaps.

* * * * *